US008302544B2

(12) United States Patent
Takashima et al.

(10) Patent No.: US 8,302,544 B2
(45) Date of Patent: Nov. 6, 2012

(54) BURNER STRUCTURE

(75) Inventors: Ryuhei Takashima, Nagasaki-ken (JP); Koutaro Fujimura, Nagasaki-ken (JP); Munehiro Kakimi, Nagasaki-ken (JP); Iwamaro Amano, Nagasaki-ken (JP); Toshihiro Hirata, Nagasaki-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 349 days.

(21) Appl. No.: 11/979,484

(22) Filed: Nov. 5, 2007

(65) Prior Publication Data

US 2008/0113309 A1 May 15, 2008

(30) Foreign Application Priority Data

Nov. 9, 2006 (JP) ..... 2006-303780

(51) Int. Cl.
*F23K 3/02* (2006.01)

(52) U.S. Cl. ..... 110/104 B; 110/260

(58) Field of Classification Search ..... 110/260, 110/261, 262, 263, 264, 265, 104 B; 431/8, 431/10, 159, 160, 181, 186, 187, 189, 279
See application file for complete search history.

(56) References Cited

U.S. PATENT DOCUMENTS

| | | | | |
|---|---|---|---|---|
| 4,252,069 | A | 2/1981 | McCartney | |
| 4,348,170 | A * | 9/1982 | Vatsky et al. | 431/188 |
| 4,422,389 | A * | 12/1983 | Schroder | 110/264 |
| 4,434,727 | A * | 3/1984 | McCartney | 110/261 |
| 4,434,747 | A * | 3/1984 | Chadshay | 110/261 |
| 5,358,222 | A | 10/1994 | Kaasinen et al. | |
| 5,407,347 | A | 4/1995 | Bortz | |
| 5,483,906 | A * | 1/1996 | Hufton | 110/261 |
| 6,189,812 | B1 * | 2/2001 | Buridant | 110/104 B |
| 6,260,491 | B1 * | 7/2001 | Grusha | 110/261 |
| 6,367,394 | B1 * | 4/2002 | Kaneko et al. | 110/261 |

(Continued)

FOREIGN PATENT DOCUMENTS

CL 601-1993 5/1994

(Continued)

OTHER PUBLICATIONS

Chilean Office Action dated Sep. 15, 2009, issued in corresponding Chilean Patent Application No. 3099-2007.

(Continued)

*Primary Examiner* — Kenneth Rinehart
*Assistant Examiner* — David J Laux
(74) *Attorney, Agent, or Firm* — Westerman, Hattori, Daniels & Adrian, LLP

(57) ABSTRACT

To provide a burner structure that is capable of efficiently cooling a nozzle main body with a small amount of air, and takes an efficient countermeasure against a falling clinker or radiation heat. The burner structure includes: a pulverized coal-air mixture path provided in a burner central portion and supplying a mixture of a fuel and a primary air; a secondary air path provided around the pulverized coal-air mixture path and supplying a secondary air; a cooling air path provided around or above and below the secondary air path and supplying a cooling air; a nozzle main body attached to furnace-side end portions of the pulverized coal-air mixture path and the secondary air path in a tiltable form and provided with a flame holder at its tip end; and a cooling air nozzle attached to a furnace-side end portion of the cooling air path in a tiltable form.

7 Claims, 6 Drawing Sheets

U.S. PATENT DOCUMENTS

| | | | | |
|---|---|---|---|---|
| 6,807,914 | B2 * | 10/2004 | Leisse et al. | 110/106 |
| 2005/0028712 | A1 | 2/2005 | Wang et al. | |
| 2006/0246387 | A1 | 11/2006 | Smirnov | |

FOREIGN PATENT DOCUMENTS

| | | | |
|---|---|---|---|
| CL | 1014-1994 | | 11/1995 |
| CN | 1243216 | A | 2/2000 |
| CN | 1112537 | C | 6/2003 |
| JP | 56-064217 | A | 6/1981 |
| JP | 60-76716 | U | 5/1985 |
| JP | 10-274403 | A | 10/1998 |
| JP | 10-332110 | A | 12/1998 |
| JP | 2003-279006 | A | 10/2003 |

OTHER PUBLICATIONS

Japanese Office Action dated Jun. 28, 2011, issued in corresponding Japanese Patent Application No. 2006-303780.

* cited by examiner

BURNER STRUCTURE

BACKGROUND OF THE INVENTION

1. Field of the Invention

The present invention relates to a burner structure applicable to various types of combustion apparatuses such as a pulverized coal boiler.

This application is based on Japanese Patent Application No. 2006-303780, the content of which is incorporated herein by reference.

2. Description of Related Art

Hitherto, boilers fired with a fuel powder, for example, pulverized coal or petroleum coke have been used.

To describe a burner structure employed in a pulverized coal boiler that is fired with pulverized coal, a burner is composed of a pulverized coal-air mixture system provided in the burner center and containing pulverized coal and a primary air, a secondary air system provided around the pulverized coal-air mixture system, and cooling air (tertiary air) systems optionally provided around or above and below the secondary air system.

FIG. 5 is a sectional view showing a pulverized coal burner structure of the related art.

A burner 10 of FIG. 5 is structured such that a secondary air path 12 as a secondary air system is provided around a pulverized coal-air mixture path 11 as a pulverized coal-air mixture system. In addition, a cooling air path 13 as a cooling air (tertiary air) system is provided above the secondary air path 12.

Provided at furnace-side ends of the pulverized coal-air mixture 11 and the secondary air path 12 is a nozzle main body 17 that integrates a pulverized coal nozzle 14 and a secondary air nozzle 15 with a flame holder 16 provided at their tip ends. Further, a cooling air nozzle 18 is attached at the furnace-side end of the cooling air path 13. The cooling air nozzle 18 functions to prevent a falling clinker from the upper part in the furnace from colliding against the burner 10 and to shield a flame radiation heat. In FIG. 5, reference numeral 19 denotes a wind box.

In the thus-structured burner 10, the following combustion method is employed. That is, a fuel and an air are supplied while the total amount of the primary air, the secondary air, and the tertiary air is set smaller than an ideal air amount relative to an amount of pulverized coal loaded to fire the burner as required by the regulations on nitrogen oxides (NOx). In this way, a main combustion zone is kept under a reducing atmosphere. Then, NOx generated upon burning the pulverized coal is reduced, after which an additional air is supplied from an additional air nozzle (not shown) provided on the downstream side of the main combustion zone for oxidation combustion. In this way, combustion is completed. Thus, enough air is supplied around a pulverized coal flow in the main combustion zone.

Further, in the burner 10 of the related art, the nozzle main body 17 is tiltable for controlling a steam temperature or an amount of NOx at the outlet as shown in FIG. 6, but the cooling air nozzle 18 is fixed.

In addition, there is reported another structure that the entire nozzle inclusive of an air flow path corresponding to the above cooling air nozzle 18 is tiltable (see the Publication of the U.S. Pat. No. 6,260,491, for instance).

Recently, an ignition performance has been enhanced year by year along with improvements in the flame holder 16. As a result, materials for the burner 10 are exposed to higher temperatures. On the other hand, if a flow rate of the cooling air supplied to the cooling air nozzle 18 is increased to increase a cooling ability, a combustion temperature lowers and causes an increase in unburned components. Thus, exhaust gas characteristics are deteriorated, so it is necessary to efficiently cool the nozzle main body 17 with a small amount of air.

Moreover, in the burner 10 of the related art, the nozzle main body 17 is only tiltable and the cooling air nozzle 18 is fixed, which causes a problem in that the tilted nozzle main body 17 is exposed to radiation heat.

On the other hand, in the structure where the entire nozzle is tiltable as disclosed in the Publication of U.S. Pat. No. 6,260,491, an air flow rate is determined in accordance with an air-flow-path area ratio, resulting in a problem in that an air flow rate cannot be adjusted during operation.

Further, the part corresponding to the cooling air nozzle 18 does not have a function of protecting the nozzle main body from a falling clinker or radiation heat, which situation might occurs in the case where a fuel powder such as pulverized coal is used. Therefore, this structure is disadvantageous from the viewpoint of ensuring a long component life.

In view of such circumstances, there is an increasing demand for a burner structure that is capable of adjusting an air flow rate and efficiently cooling a nozzle main body with a small amount of air, and takes an efficient countermeasure against a falling clinker or radiation heat.

BRIEF SUMMARY OF THE INVENTION

The present invention has been accomplished in view of the above circumstances, and it is an object of the present invention to provide a burner structure that is capable of adjusting an air flow rate and efficiently cooling a nozzle main body with a small amount of air, and takes an efficient countermeasure against a falling clinker or radiation heat.

The present invention adopts the following solutions with a view to attaining the above object.

A burner structure according to the present invention includes: a fuel-air mixture system provided in a burner central portion and supplying a mixture of a fuel and a primary air; a secondary air system provided around the fuel-air mixture system and supplying a secondary air; a cooling air system provided around or above and below the secondary air system and supplying a cooling air; a nozzle main body attached to furnace-side end portions of the fuel-air mixture system and the secondary air system in a tiltable form and provided with a flame holder at its tip end; and a cooling air nozzle attached to a furnace-side end portion of the cooling air system in a tiltable form.

According to the above burner structure, since the burner structure includes a nozzle main body attached to furnace-side end portions of the fuel-air mixture system and the secondary air system in a tiltable form and provided with a flame holder at its tip end, and a cooling air nozzle attached to a furnace-side end portion of the cooling air system in a tiltable form, the secondary air and the cooling air are independently supplied from different air supply systems. Hence, an air flow rate can be adjusted and controlled in each air supply system.

In the burner structure, it is preferred that a tip end position of the cooling air nozzle be substantially the same as a tip end position of the flame holder in a tiltable range of the nozzle main body and the cooling air nozzle because an influence of a falling clinker or radiation heat on the nozzle main body can be eradicated or suppressed.

In the burner structure, it is preferred that the cooling air nozzle include a canopy-like member for partitioning an inner portion of a tubular member, and a tip end of the canopy-like member be adjusted to substantially the same position as a tip end of the flame holder in a tiltable range of the nozzle main body and the cooling air nozzle because the cooling air nozzle can be made lightweight, and an influence of a falling clinker or radiation heat on the nozzle main body can be eradicated or suppressed.

In the burner structure, it is preferred that the cooling air nozzle be provided with a cooling fin because a cooling efficiency is improved.

Further, in the burner structure according to the present invention, it is preferred that axes of tilt of the nozzle main body and the cooling air nozzle coincide with each other because a tilting mechanism can be simplified.

In the burner structure, it is preferred that the cooling air nozzle be detachably attached to the nozzle main body because the cooling air nozzle can be replaced alone.

In this case, a flow rate of an air supplied to the cooling air and the secondary air is determined in accordance with a sectional area ratio, so a wind box structure can be simplified.

According to the burner structure of the present invention, it is possible to adjust an air flow rate and more efficiently cool a nozzle main body with a small amount of air, and protect a nozzle main body from a falling clinker or radiation heat.

DETAILED DESCRIPTION OF THE INVENTION

Hereinafter, embodiments of a burner structure according to the present invention will be described with reference to the accompanying drawings.

First Embodiment

Figure 1:
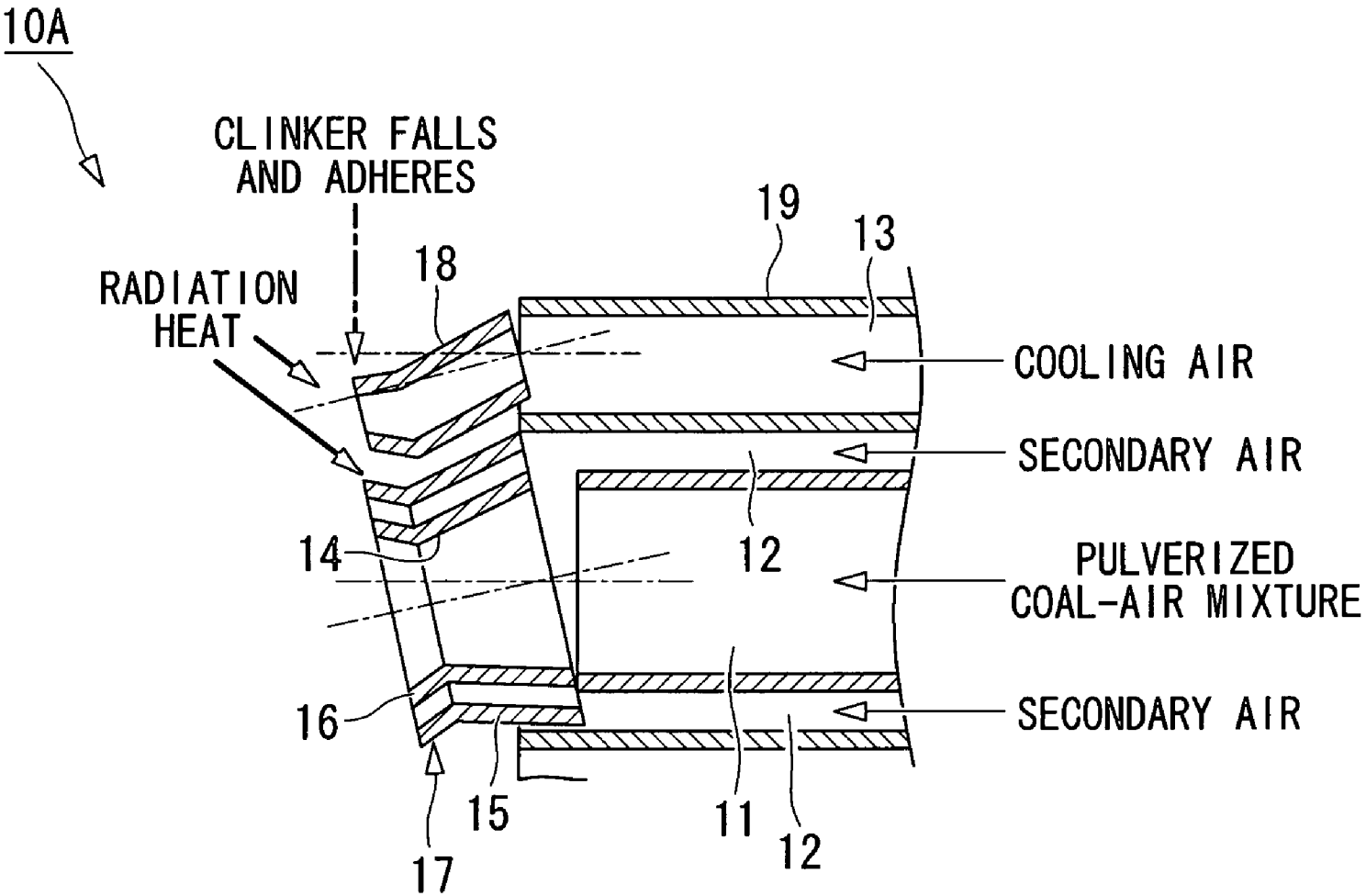
FIG. 1 is a sectional view of a burner structure according to a first embodiment of the present invention.

A burner structure according to a first embodiment of the present invention as shown in FIG. 1 is a pulverized coal burner used for a pulverized coal boiler fired with pulverized coal as a fuel.

Figure 7:
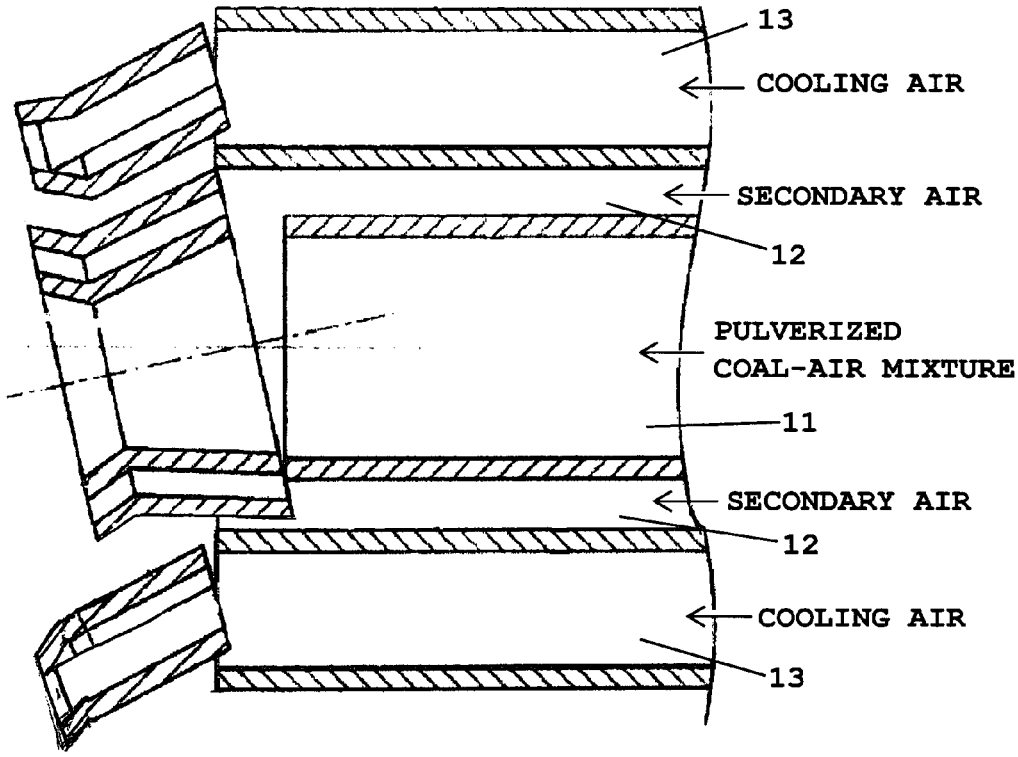
FIG. 7 is a sectional view of a burner structure according to an alternative embodiment of the present invention.

This burner 10A includes a pulverized coal-air mixture path 11 that is provided in the burner center as a fuel-air mixture system for supplying a pulverized coal-air mixture containing pulverized coal as a fuel and a combustion primary air. A secondary air path 12 as a secondary air system for supplying a combustion secondary air is provided around the pulverized coal-air mixture path 11. In addition, a cooling air path 13 as a cooling air system for supplying a cooling tertiary air (hereinafter referred to as "cooling air") is provided above the secondary air path 12. Alternatively, the cooling air system may be provided around the secondary air system as shown in FIG. 7.

To take an example of the case where pulverized coal is used as a fuel, a pulverized coal-air mixture is set to about 80° C. and supplied to the pulverized coal-air mixture path 11 in the burner center. Moreover, a secondary air and a cooling air are set to about 300° C. to 350° C. and supplied to the secondary air path 12 and the cooling air path.

A nozzle main body 17 is attached to furnace-side end portions of the pulverized coal-air mixture path 11 and the secondary air path 12, and a tilting mechanism (not shown) is provided, so the nozzle can be tilted to change a blowoff angle from a horizontal angle to a desired one. The nozzle main body 17 is completed by combining a pulverized coal nozzle 14 that ejects a pulverized coal-air mixture and a secondary air nozzle 15 that ejects a secondary air, and integrally attaching a flame holder 16 to tip ends of both the nozzles.

To describe the structure of the nozzle main body 17 in detail, the pulverized coal nozzle 14 has a tapered tube-like form, and the secondary air nozzle 15 similarly has a tapered tube-like form with a large diameter and is integrally provided around the pulverized coal nozzle 14. The pulverized coal nozzle 14 and the secondary air nozzle 15 constitute a double-walled tube-like structure with a large diameter. Then, the flame holder 16 that has similarly a double-walled tube-like structure and increases its diameter toward an outlet at the tip end is integrally attached to tip ends of the pulverized coal nozzle 14 and the secondary air nozzle 15.

A cooling air nozzle 18 is provided at a furnace-side end portion of the cooling air path 13 independently of the nozzle main body 17. The cooling air nozzle 18 is provided with a tilting mechanism (not shown) similar to the nozzle main body 17 and thus can be tilted to change a blowoff angle from a horizontal angle to a desired one. The cooling air nozzle 18 has a tube-like shape, and it is preferred that its tip end position on the outlet side be substantially the same as that of the flame holder 16 in a tiltable range of the nozzle main body 17 and the cooling air nozzle 18.

In the thus-structured burner 10A, the cooling air path 13 for supplying a cooling air to the cooling air nozzle 18 is independent of the pulverized coal-air mixture path 11 and the secondary air path 12, so a flow rate of the cooling air can be adjusted and controlled solely. To be specific, a flow rate of the cooling air can be controlled independently of a pulverized coal-air mixture or a secondary air by providing the cooling air path 13 with a flow rate adjusting part such as a damper.

As a result, a flow rate of the cooling air can be adjusted and controlled more precisely and finely than a conventional structure that determines an air flow rate in accordance with a path sectional area ratio. Hence, if a flow rate of the cooling air is optimized in accordance with operation conditions, the nozzle main body 17 can be efficiently cooled. In addition, the cooling air nozzle 18 is independent of the nozzle main body 17, so if the cooling air nozzle needs to be replaced as a result of periodical checkup or the like, only the nozzle can be replaced.

Further, also in the case where the cooling air nozzle 18 is tilted to thereby tilt the nozzle main body 17, if the cooling air nozzle 18 is tilted to the best position, a falling clinker adheres to the cooling air nozzle 18 first. Hence, it is possible to shield radiation heat with the cooling air nozzle as well as to prevent the clinker from adhering to the nozzle main body 17, so the nozzle main body 17 is not directly exposed to radiation heat.

If the outlet-side tip end position of the cooling air nozzle 18 is substantially the same as a tip end position of the flame holder 16 in a tiltable range of the nozzle main body 17 and the cooling air nozzle 18, the nozzle main body 17 can be protected from a clinker or radiation heat with higher reliability.

Incidentally, in the case of tilting the cooling air nozzle 18 to protect the nozzle main body 17 from a clinker or radiation heat, if axes of tilt of the cooling air nozzle 18 and the nozzle main body 17 coincide with each other, the structure can be simplified, for example, the tilting mechanism is shared. Here, the cooling air nozzle 18 and the nozzle main body 17 may be integrally formed so that both nozzles are always tilted to the same direction at the same time.

Second Embodiment

Figure 2A:
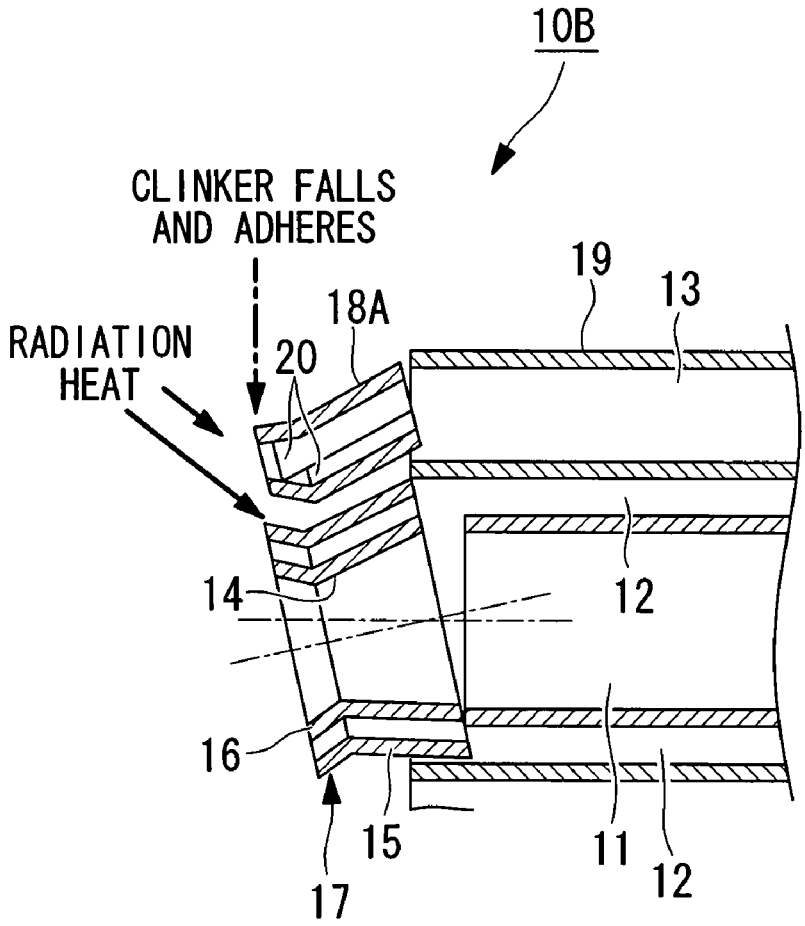
FIG. 2A is a sectional view of a burner structure according to a second embodiment of the present invention.
Figure 2B:
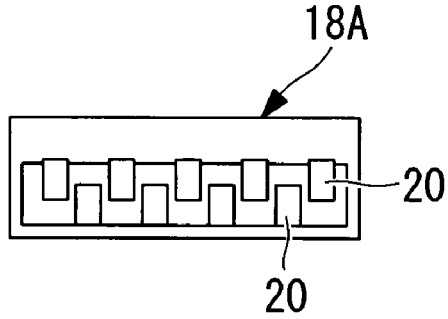
FIG. 2B shows the burner structure of the second embodiment and a cooling air nozzle as viewed from the front on the outlet side.

Referring next to FIGS. 2A and 2B, a burner structure according to a second embodiment of the present invention will be described. Here, the same components as those of the above embodiment are denoted by identical reference numerals, and detailed description thereof is omitted.

A burner 10B of this embodiment includes cooling fins 20 provided inside a tube-like cooling air nozzle 18A. The cooling fins 20 alternately protrude from an upper surface and a lower surface of the inner portion of the tube-like nozzle as shown in FIG. 2B, but the present invention is not limited to this structure. If the cooling air nozzle 18A is provided with the cooling fins 20 in this way, a contact area with a cooling air is increased to improve a cooling efficiency. Incidentally, the cooling air nozzle 18A is tiltable as in the above cooling air nozzle 18.

Third Embodiment

Figure 3A:
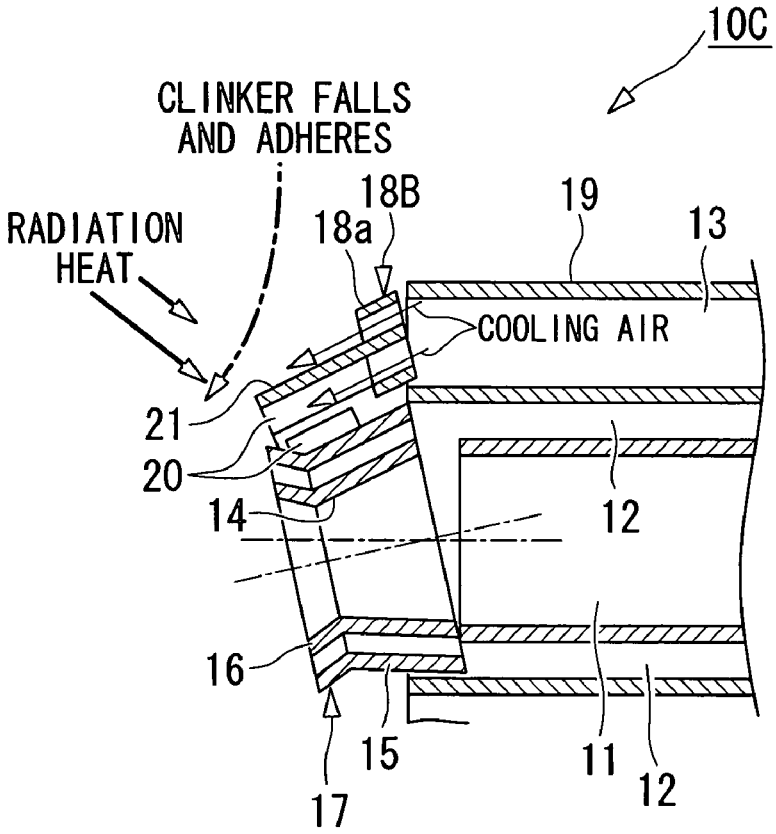
FIG. 3A is a sectional view of a burner structure according to a third embodiment of the present invention.
Figure 3B:
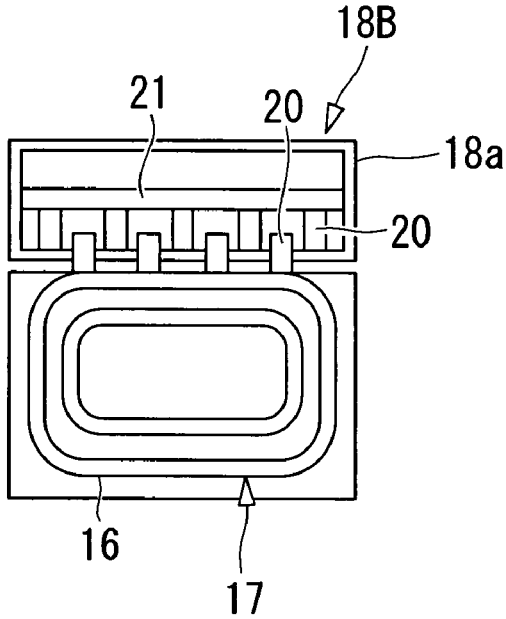
FIG. 3B shows the burner structure of the third embodiment and a burner as viewed from the front on the outlet side.

Referring next to FIGS. 3A and 3B, a burner structure according to a third embodiment of the present invention will be described. Here, the same components as those of the above embodiments are denoted by identical reference numerals, and detailed description thereof is omitted.

A burner 10C (10D) of this embodiment includes a canopy-like member 21 of a plate shape, which partitions an inner portion of a tube-like cooling air nozzle 18B, and is tiltable as in the cooling air nozzle 18. The canopy-like member 21 is provided to partition the inner portion of the cooling air nozzle 18B obtained by cutting a tube main body 18*a* into upper and lower portions. A tip end position of the canopy-like member 21 is substantially the same as the tip end position of the flame holder 16 in a tiltable range of the nozzle main body 17 and the cooling air nozzle 18.

If the cooling fins 20 are optionally attached to, for example, an upper surface of the canopy-like member 21, a cooling efficiency can be improved. In the illustrated example, the fins alternately protrude from a lower surface of the canopy-like member 21 and an upper surface of the nozzle main body 17, but the present invention is not limited to this structure.

In the thus-structured cooling air nozzle 18B, the tube main body 18*a* is shortened and thus, the nozzle itself can be made lightweight. Further, the canopy-like member 21 can shield radiation heat as well as prevent a clinker from adhering to the nozzle main body 17, so the nozzle main body 17 is not directly exposed to radiation heat.

Moreover, if the canopy-like member 21 is detachably attached to the tube main body 18*a* by means of bolts or the like, in the case where the canopy-like member 21 needs to be replaced as a result of periodical checkup or the like, only the member can be replaced.

Figure 4:
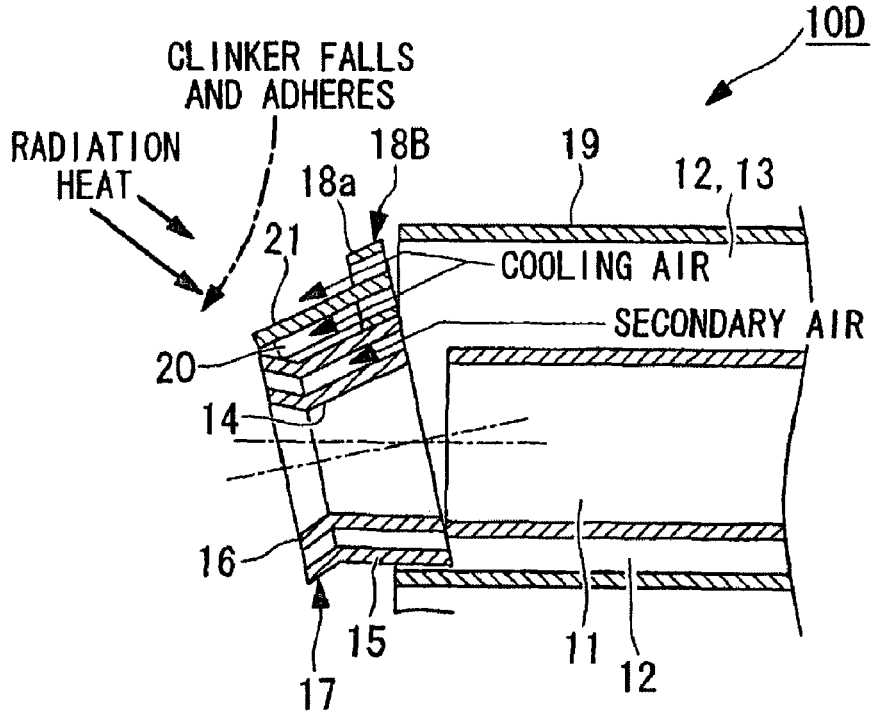
FIG. 4 is a sectional view of a modified example of the third embodiment of FIGS. 3A and 3B.
Figure 5:
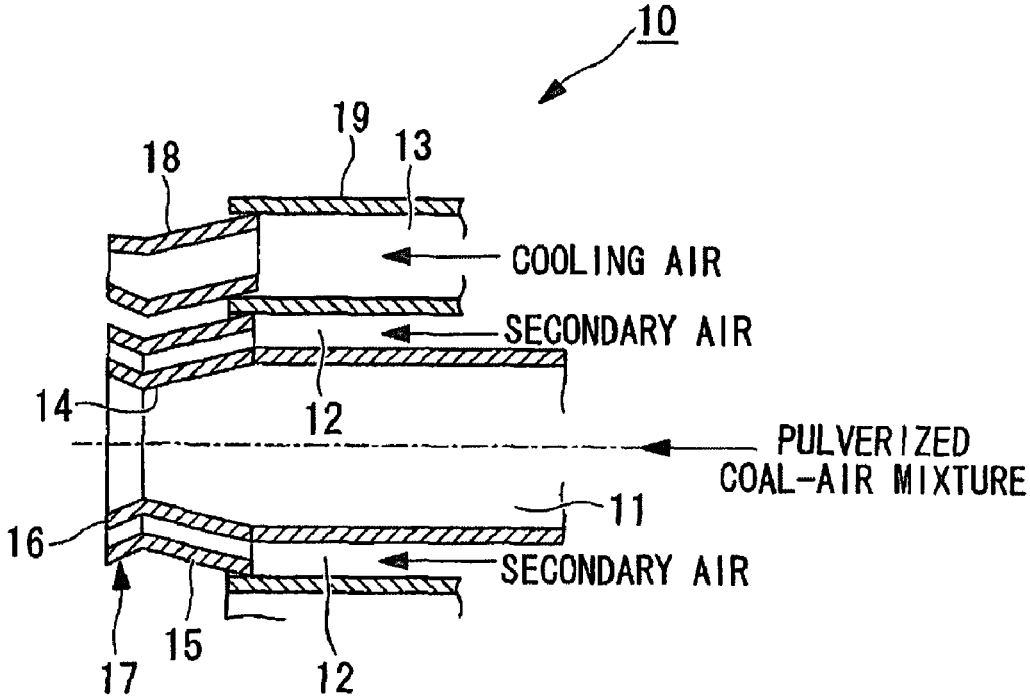
FIG. 5 RELATED ART
FIG. 5 is a sectional view of a burner structure of the related art.
Figure 6:
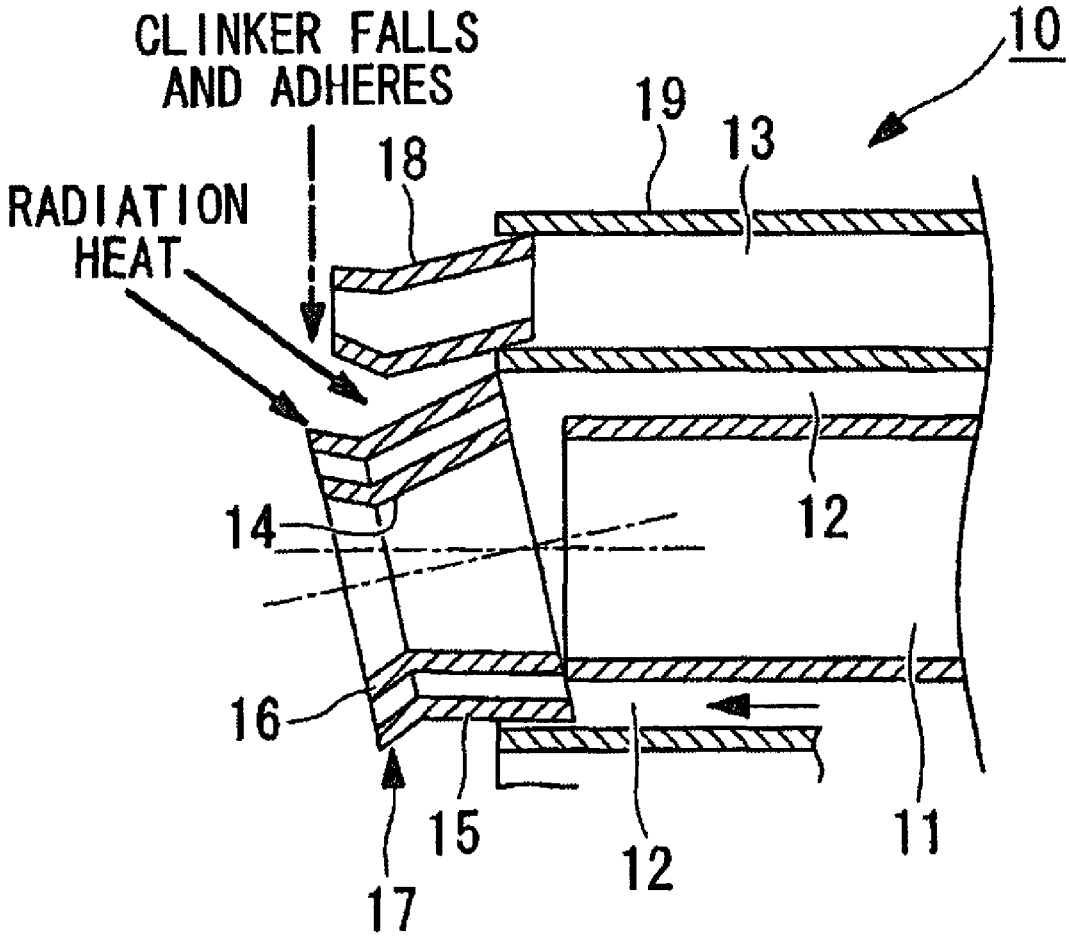
RELATED ART FIG. 6
FIG. 6 is a sectional view of the burner structure of the related art in a tilted form.

Further, air flow rates of a secondary air and a cooling air may be determined in accordance with a sectional area ratio instead of using the member that partitions a wind box 19 into the secondary air path 12 and the he cooling air path 13 as in a modified example of FIG. 4. According to this structure, the wind box structure can be made simple and lightweight.

Further, if the cooling air nozzle 18B is detachably attached to the nozzle main body 17 by means of bolts or the like and integrated with the nozzle main body, the cooling air nozzle 18B and the nozzle main body 17 can be tilted at the same time, and the cooling air nozzle 18B can be replaced alone.

As set forth above, the burner structure according to the present invention can adjust an air flow rate and thus efficiently cool the nozzle main body 17 with a small amount of air, and can protect the nozzle main body 17 from a falling clinker or radiation heat.

The present invention is not limited to the above-described embodiments and might be modified as appropriate without departing from the scope of the present invention. For example, a fuel is not limited to pulverized coal, and petroleum coke, fuel oil, or fuel gas can be used instead.

What is claimed is:

1. A burner structure comprising:

a fuel-air mixture system provided in a burner central portion and supplying a mixture of a fuel and a primary air, said fuel-air mixture system protruding a distance inside an inner wall of a furnace;

a secondary air system provided circumferentially around the fuel-air mixture system and supplying a secondary air;

a cooling air system provided circumferentially around the secondary air system and supplying a cooling air;

a nozzle main body attached to furnace-side end portions of the fuel-air mixture system and the secondary air system in a tiltable form and provided with a flame holder at its tip end; and a cooling air nozzle attached to a furnace-side end portion of the cooling air system in a tiltable form;

wherein a tip end position of the cooling air nozzle protrudes substantially the same distance inside the inner wall of the furnace as a tip end position of the flame holder in a tiltable range of the nozzle main body and the cooling air nozzle.

2. The burner structure according to claim 1, wherein the cooling air nozzle includes a canopy-like member for partitioning an inner portion of a tubular member, and a tip end of the canopy-like member is adjusted to protrude substantially the same distance inside the inner wall of the furnace as a tip end of the flame holder in a tiltable range of the nozzle main body and the cooling air nozzle.

3. The burner structure according to claim 2, wherein the cooling air nozzle is detachably attached to the nozzle main body.

4. The burner structure according to claim 3, wherein a flow rate of an air supplied to the cooling air and the secondary air is determined in accordance with a sectional area ratio.

5. The burner structure according to claim 1, wherein the cooling air nozzle is provided with a cooling fin.

6. The burner structure according to claim 1, wherein axes of tilt of the nozzle main body and the cooling air nozzle coincide with each other.

7. The burner structure according to claim 1, wherein a cooling air path for supplying the cooling air to the cooling air nozzle is independent of a fuel-air mixture path for supplying the mixture of fuel and primary air and independent of a path for supplying the secondary air;

the cooling air path including an adjuster for adjusting the flow rate of the cooling air independently of the flow rate of the fuel-air mixture and independently of the secondary air by providing the cooling air path with a flow rate adjusting damper.

* * * * *